US005796031A

United States Patent [19]

Sigler

[11] Patent Number: 5,796,031

[45] Date of Patent: Aug. 18, 1998

[54] FOWARD FIN FLECHETTE

[75] Inventor: John W. Sigler, La Mirada, Calif.

[73] Assignee: Primex Technologies, Inc., Downey, Calif.

[21] Appl. No.: 798,204

[22] Filed: Feb. 10, 1997

[51] Int. Cl.[6] ..... F42B 14/06; F42B 12/64

[52] U.S. Cl. ..... 102/520; 102/438; 102/439; 102/489; 102/494; 102/521; 102/703; 244/3.24

[58] Field of Search ..... 102/393, 432, 102/438, 439, 448–489, 494, 495, 496, 497, 501, 517, 520–523, 703; 244/3.24, 3.3; 473/578–580, 586; 273/216, 217, 220, 223; 86/1.1

[56] References Cited

U.S. PATENT DOCUMENTS

| | | | |
|---|---|---|---|
| 3,011,404 | 12/1961 | Russel . | |
| 3,269,268 | 8/1966 | Gould | 102/393 |
| 3,515,072 | 6/1970 | Barr | 102/517 |
| 3,637,449 | 1/1972 | Raech, Jr. | 102/501 |
| 3,673,047 | 6/1972 | Buth et al. | 102/703 |
| 3,797,359 | 3/1974 | Mawhinney et al. . | |
| 3,802,345 | 4/1974 | La Costa | 102/438 |
| 4,430,941 | 2/1984 | Raech, Jr. et al. | 102/501 |
| 4,638,737 | 1/1987 | McInquale | 102/489 |
| 4,770,101 | 9/1988 | Robertson et al. | 102/489 |
| 4,922,826 | 5/1990 | Busch et al. | 102/489 |
| 5,107,767 | 4/1992 | Schneider et al. . | |
| 5,325,786 | 7/1994 | Petrovich | 402/438 |

*Primary Examiner*—Harold J. Tudor
*Attorney, Agent, or Firm*—Gregory S. Rosenblatt; Wiggin & Dana

[57] ABSTRACT

A multi-flechette weapon packing for a flechette holding canister has one set of fin back flechettes, each having a tip end and a fin end with a plurality of integral fins at the fin end and a plurality of fin forward flechettes, each having a tip end and an opposite end and a plurality of integral fins offset from the opposite end toward the tip end. The fin back flechettes and fin forward flechettes are located in the canister and adjacent to each other in an alternating fashion with the tip ends aligned in the same direction to increase packing density.

6 Claims, 4 Drawing Sheets

FOWARD FIN FLECHETTE

BACKGROUND OF THE INVENTION

1. Field of the Invention

This invention relates to multi-flechette weapons, more particularly, this invention relates to increasing the packing density of the flechettes.

2. Description of Related Art

A common approach to anti-personnel cartridge design provides a canister projectile containing a plurality of anti-personnel flechettes. Flechettes are small, generally arrow shaped, projectiles typically impact-formed from wire stock or struck from dies. At an end opposite a pointed end, are typically a plurality of fins, or vanes.

Various techniques provide for packing the flechettes into the canister projectile. One packing technique is illustrated in U.S. Pat. No. 3,797,359 issued to Mawhinney et al. and consists of layering the flechettes. The layering consists of providing a first layer of flechettes and a second layer such that the bottoms of the fins of the second layer of flechettes contact the tops of the fins of the first layer of flechettes. The packing, therefore, has a length at least equal to the length of a flechette plus the fin length.

Another known technique provides a tip-to-tail configuration in which a first layer faces in the direction of flight and a second layer faces opposite to the direction of flight. The tips of the second layer interleave along the tails of the first layer and the tips of the first layer interleave with the tails of the second layer resulting in a packing density greater than that of Mawhinney because the length in this second technique provides a length at least equal to the length of a flechette.

The tip-to-tail approach requires the backward facing flechettes to reorient themselves once expelled from the canister projectile. Observations from test firings and analytical modeling suggest that the backward facing flechettes, once starting to tumble to reorient themselves, cannot readily stop from tumbling. Additionally, computational models that include the backward facing flechettes having fins double the size of conventional fins also suggest that they would also tend to not stop tumbling.

There exists, therefore, a need to develop a packing methodology or flechette structure that provides for a dense packing while maintaining effect dispersion and aerodynamically stable flight.

SUMMARY OF THE INVENTION

Accordingly, a multi-flechette weapon is provided that eliminates the problems of the prior art and improves the packing density of flechettes in a flechettes canister.

In accordance with the invention, there is provided a multi-flechette weapon including a flechette holding canister. In the holding canister is disposed a first set of flechettes, each having a tip end and a fin end with a number of fins at the fin end along with a second set of flechettes, each having a tip end and an opposite end and a plurality of fins offset from the opposite end toward the tip end. The first flechettes and second flechettes are adjacent to each other in an alternating fashion with their tip ends aligned in the same direction.

The above stated features will become more apparent from the specification and drawings that follow.

It is to be understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate an embodiment of the invention and together with the description, serve to explain the principles of the invention.

DETAILED DESCRIPTION OF THE INVENTION

Figure 1:
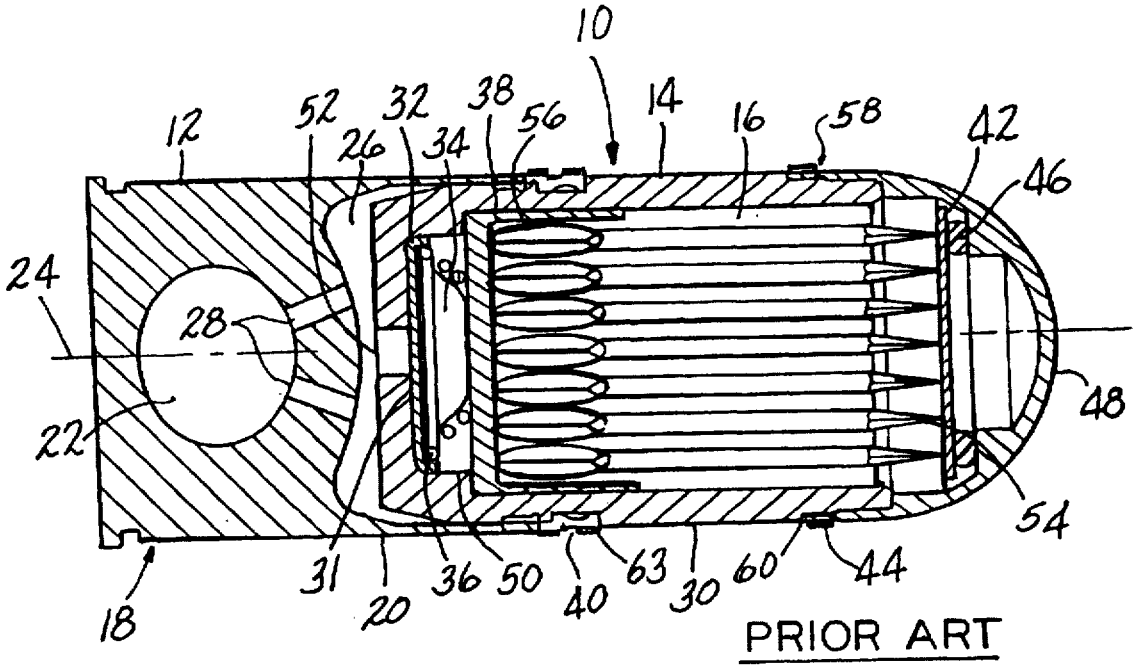
FIG. 1 illustrates a typical multi-flechette cartridge according to the prior art.

Reference will now be made in detail to the present preferred embodiments of the invention, examples of which are illustrated in the accompanying drawings, where like or similar parts are identified by the same reference characters.

The typical multi-flechette cartridge as known from the prior art is shown in a cross section view in FIG. 1 and is designated generally by the reference numeral 10. The cartridge 10 includes a body 12 and a multi-flechette canister 14 containing a plurality of flechettes 16.

The body 12 is cylindrical in shape and includes a base portion 18, a canister receiving portion 20, and a cavity 22. The base portion 18 contains cavity 22 which is offset from the walls of the base portion 18 and along a longitudinal axis 24. The cavity 22 is spherical in shape. The walls of the canister receiving portion 20 define a cup shaped cavity 26 into which the multi-flechette canister 14 fits. Ports 28 connect the cavity 22 to the cup shaped cavity 26.

The canister 14 includes a canister body 30, a valve plate 32, an explosive charge 34, a spring 36, a pusher 38, an obturator 40, a retaining disk 42, a shear strip 44, a rubber band 46, and a nosecap 48. The canister body 30 is cup shaped and adapted so that the closed end of the cup slides into the canister receiving cavity 26 of the body 12. At a base 31 of the cup shape of the canister body 30 is the valve plate 32. The valve plate 32 is also cup shaped and aligned in the same direction as the canister body 30, but the valve plate 32 cup depth is shallower than canister body 30 and the width of the valve plate 32, as measured transverse to the axis 24, is less than the width of the base 31. The pusher 38 is cup shaped and aligned in the same direction as the canister body 30 and fits into the canister body 30 against an circumferentially inwardly projecting support portion 50 at the base 31. The spring 36 is generally conical and sits between the pusher 38 and the valve plate 32, biasing the valve plate 32 against the base 31. The canister body 30 includes a port 52 located on the axis 24 and having a diameter transverse to the axis 24 less than the diameter of the valve plate 32. Within a cavity defined by the spring 36 and the valve plate 32 is the explosive charge 34.

The flechettes 16 include a tip end 54, a middle portion 55, and a fin end 56 and are packed into the pusher 38 so that the fin ends 56 abut the base of the pusher 38. The nose cap 48 fits against a circumferential recess 58 on the canister body 30 and covers the tip ends 54. The shear strip 44 fits into a circumferential recess 60 on canister body 30 adjacent to the lower end of the nose cap 48. The rubber band 46 between the nose cap 48 and the retaining disk 42 biases the retaining disk 42 against the tip ends 54. The obturator 40 fits in a circumferential recess 63 on the canister body 30.

In operation, the canister cartridge 10 is placed in a large caliber barrel 62 as illustrated in FIG. 2(*a*). A gaseous source 64 in cavity 22 is ignited and the gases generated pass through ports 28 into the cavity 26. The gases force the canister body 30 to separate from the cartridge body 12 and travel in the direction 66 down the barrel 62 as illustrated in FIG. 2(*b*). The gases also press against the valve plate 32 by passing through the port 52. The pressure of the gases is sufficient to force the valve plate 32 away from abutting the base 31 and toward the pusher 38. When this happens, the gasses pass around the edges of the valve plate 32 and contact the explosive charge 34 causing it to ignite. The ignition of the expulsion charge 34 causes the nose cap 48 to separate from the body 30 and the rubber band 46 provide the nose cap with a slight additional acceleration as compared to the pusher 38 as illustrated in FIG. 2(*c*). The nose cap 48, the rubber band 46, and the retaining disk 42 exit the barrel 66 prior to the flechettes 16 and fall to the side as illustrated in FIG. 2(*d*). The flechettes 16 continue to their target (not shown) while the remainder of the components exit the barrel 62 and fall to the ground.

Figure 3:
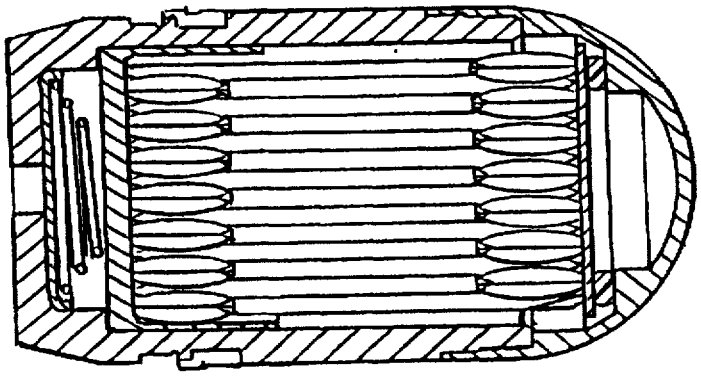
PRIOR ART FIG-3
FIG. 3 illustrates a tip-to-tail packing configuration of flechettes in a multi-flechette cartridge according to the prior art.
Figure 2A:
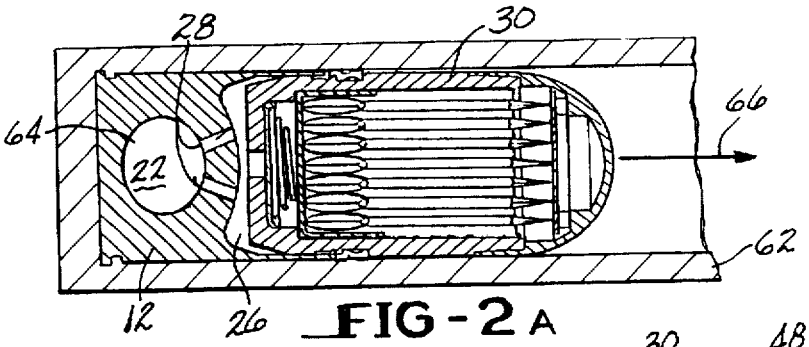
FIGS. 2(*a*)–2(*d*) illustrates a typical firing sequence of the cartridge of FIG. 1 according to the prior art.
Figure 2B:
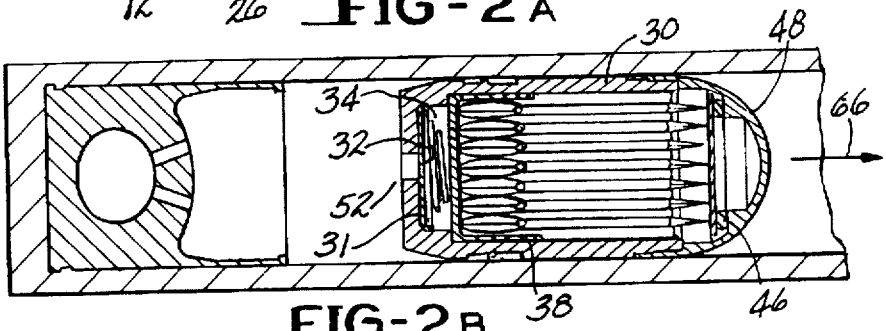
Figure 2C:
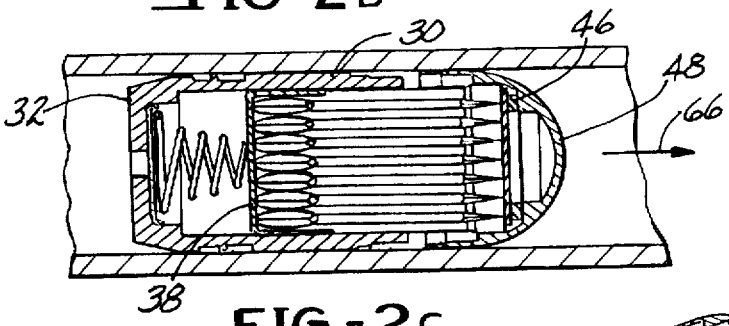
Figure 2D:
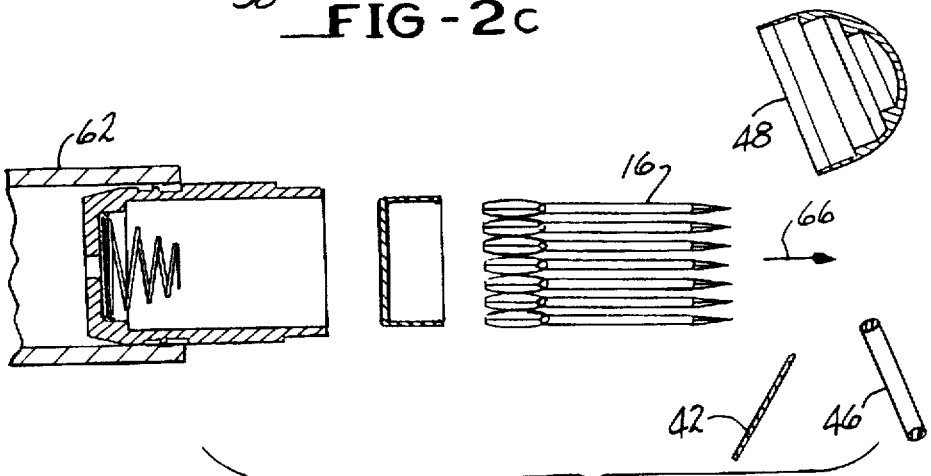
PRIOR ART FIG-2D

The packing density of the flechettes 16 according to the typical cartridge 10 as previously known and described above suffers because the fin ends 56 of adjacent flechettes 16 abut but do not interleave such that a middle portion 55 of adjacent flechettes 16 abut. Thus, where adjacent middle portions 55 do not abut results in wasted space. One attempt to increase the packing density as illustrated in FIG. 3 provides for one half of the flechettes 16 with their tip ends 54 aligned in the direction of travel 66 and one half of the flechettes 16 aligned with their tip ends 54 opposite to the direction of travel 66, resulting in a tip-to-tail packing configuration.

Figure 4:
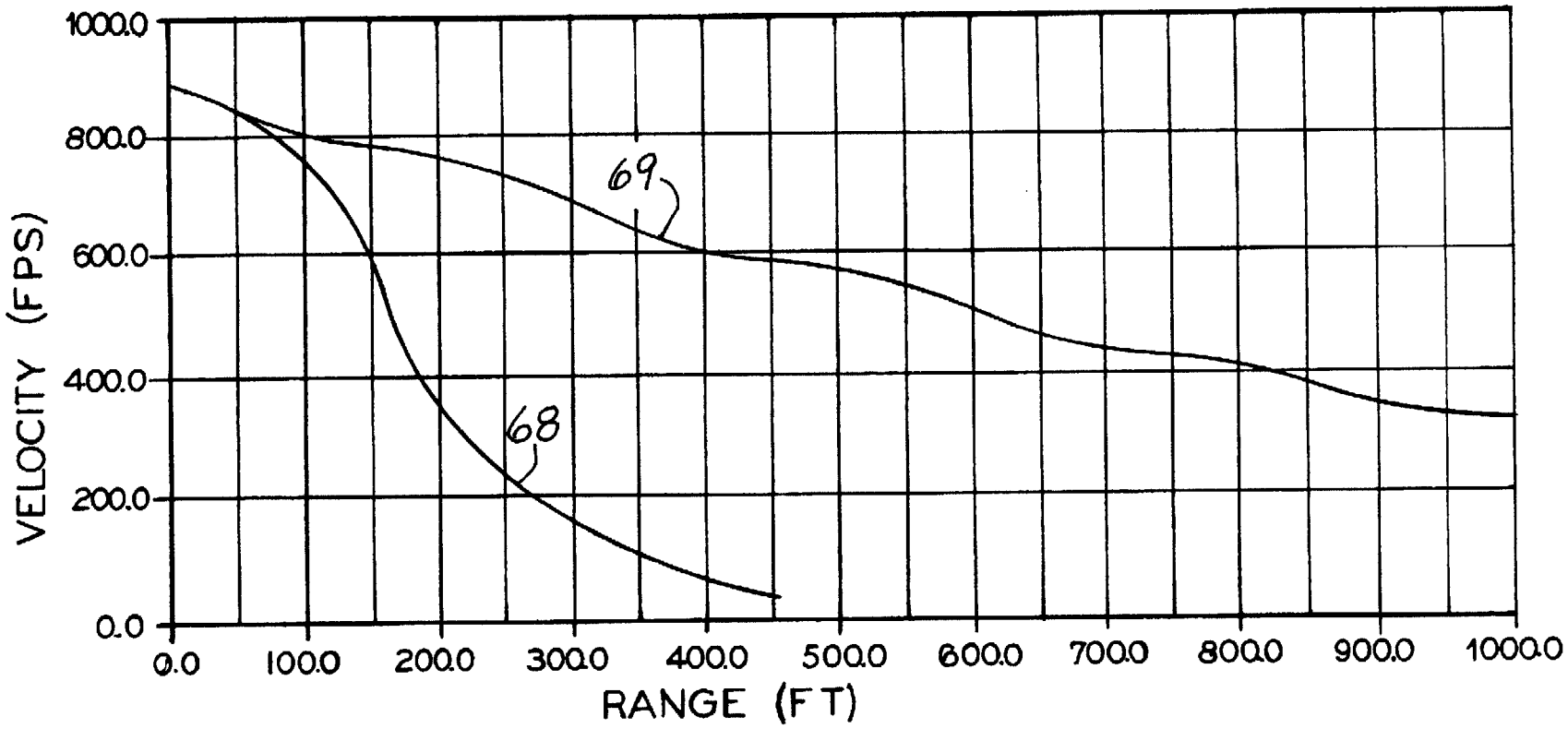
FIG. 4 illustrates velocity profiles for tumbling and non-tumbling flechettes.

As a result of the configuration, the half of the flechettes 16 aligned opposite to the direction of travel 66 must reorient themselves after exiting the barrel 62 to become aligned in the direction of travel 66. Once these flechettes 16 begin to tumble to reorient themselves, they have a tendency not to stop tumbling. The tumbling causes the flechettes 16 to disperse and strike the target in a greater dispersion than if they had been correctly aligned. FIG. 4 illustrates a velocity profile 68 for a tumbling flechette and a velocity profile 69 for a non-tumbling flechette with range on the x-axis in feet and velocity on the y-axis in feet per second. The FIG. 4 shows that a tumbling flechette loses velocity more quickly than a non-tumbling flechette and travels less far.

Figure 5:
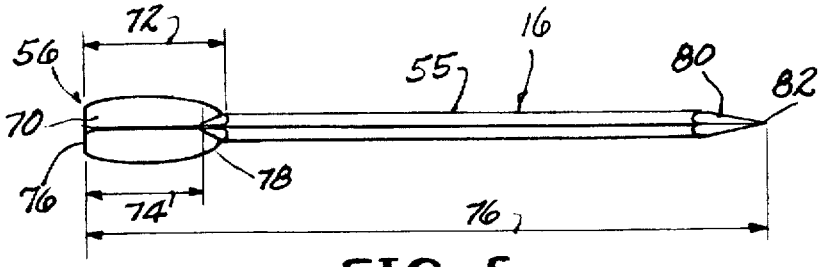
FIG-5 PRIOR ART
FIG. 5 illustrates a typical flechette used in the cartridge of FIG. 1 according to the prior art.

FIG. 5 illustrates a known flechette 16. The fin end 56 includes a plurality of fins 70. The number of fins depends on the desired aerodynamic features of the flechette 16. One preferred number of fins is four, each fin making a ninety degree angle with its two adjacent neighbors. The shape of the fins may take on various aerodynamic shapes, one of which is illustrated in FIG. 5. A length 72 of the fin 70 as measured at its maximum length along the direction of travel is from about 0.755 to about 0.795 inch. The fins 70 also include a second length 74 that is the length of the fin 70 from an edge 76 of the fin end 56 to a transition portion 78 where the fins 70 transition to the middle portion 55. The second length 74 is from about 0.335 inch to about 0.375 inch. The flechette 16 has a length 76 from about 1.97 inches to about 2.03 inches. The tip portion 54 includes a taper 80 where the middle portion 55 tapers to a point 82.

Figure 6:
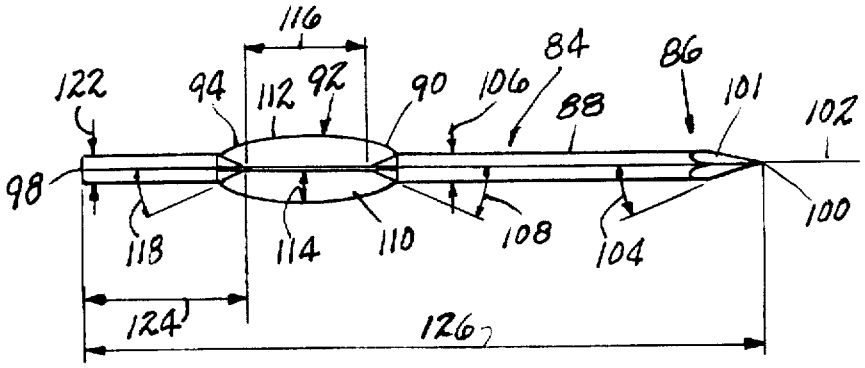
FIG. 6 illustrates a flechette according to invention.

FIG. 6 illustrates a fin forward flechette 84 according to one embodiment of the invention. The flechette 84 includes a tip end 86, a forward rod portion 88 integral to the tip end 86, a forward transition portion 90 integral to the forward rod portion 88, a fin portion 92 integral to the forward transition portion 90, an end transition portion 94 integral to the fin portion 92, end rod portion 96 integral to the end transition portion 94, and a rod end 98.

The tip end 86 provides a transition point from the forward rod portion 88 to a tip 100. The transition may be by a plurality of surfaces 101 on the forward rod portion 88 intersecting at the tip 100 and having an angle 104 of about 9° to about 13° to a longitudinal axis 102 of the flechette 84. Equally preferred, the tip end portion could be conical in shape having an angle 104 of about 9° to about 13° to the axis 102. Most preferred, the number of surfaces is four equally spaced around the forward rod portion 88. The forward rod portion 88 has a diameter 106 transverse to the axis 102 from about 0.078 inch to about 0.084 inch, more preferably, the diameter 106 is from about 0.079 inch to about 0.083 inch. The forward rod portion 88 is tubular in shape, but could include a plurality of surfaces running along its length.

The forward transition portion 90 provides a transition from the forward rod portion 88 to the fin portion 92. The forward transition 90 portion includes a portion of the fins and a portion of the forward rod portion 88. The forward rod portion 88 transitions to the fin portion 92 with a transition angle 108 from about 15° to about 25°, more preferably, the transition angle 108 is from about 18° to about 22°.

The fin portion 92 includes a plurality of fins 110 that are offset from the rod end 98 toward the tip end 86. Preferably, this offset is a distance at least equal to half a length 116 of one of the integral fins 92. The fins 110 are disposed symmetrically about the circumference of the flechette 84 and a portion of each fin 100 extends into the forward transition portion 90 and also the end transition portion 94. Preferably, the number of fins is four, but other numbers are equally preferred. The fins 110 are generally concave in shape toward to the axis 102 and have a thickness 112 and a height 114 from the axis 102 to the edge of the concave shape farthest from the axis 102. Generally, the fins 110 may be any aerodynamic shape, with FIG. 6 illustrating but one preferred shape. The thickness 112 is from about 0.010 inch to about 0.022 inch, more preferred, the thickness 112 is from about 0.011 inch to about 0.021 inch. The height 114 is from about 0.07 inch to about 0.13 inch, more preferably, the height 114 is from about 0.085 inch 0.115 inch. The fin portion 92 has a length 116 along the axis 102 from about 0.30 inch to about 0.40 inch, more preferably, the length 116 is from about 0.33 inch to about 0.37 inch. A pair of fins 110 preferably exhibits a minimum area of 0.0525 square inch.

The end transition portion 94 provides a transition from the fin portion 92 to the rod end portion 96. The transition portion 94 includes a portion of the fins 110, and a portion of the rod end portion 96. The rod end portion 96 transitions from the fin portion 92 with a transition angle 118 from about 15° to about 25°, more preferably, the transition angle 118 is from about 18° to about 22°.

The end rod portion 96 has a diameter 120 transverse to the axis 102 from about 0.078 inch to about 0.084 inch, more preferably, the diameter 120 is from about 0.079 inch to about 0.083 inch. The end rod portion 96 is tubular in shape, but could include a plurality of surfaces running along its length. A length 124 along the axis 102 includes the length of the rod end portion 96 and the end transition portion 94 and is from about 0.47 inch to about 0.52 inch, more preferably, the length 124 is from about 0.48 inch to about 0.50 inch.

The flechette 84 has a total length 126 as measured along the axis 102 from about 1.95 inches to about 2.05 inches, more preferably, the length 126 is from about 1.97 inches to about 2.03 inches. The flechette 84 may be made from various materials including hardened steel alloys, steel wire, carbon, cold-heading quality, annealed or sperodized annealed in process, grade 1038 UNS G10380, being preferred.

Figure 7:
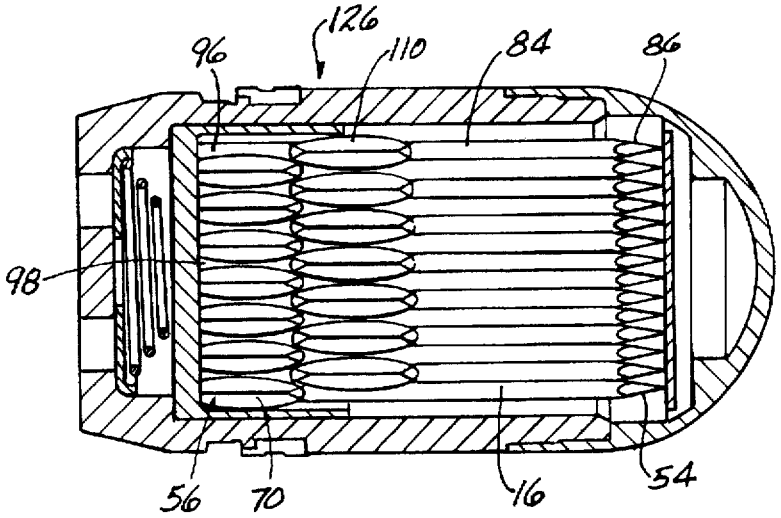
FIG. 7 illustrates the flechettes of FIGS. 5 and 6 in a packing configuration according to a preferred embodiment of the present invention.

FIG. 7 illustrates a packing according to one embodiment of the invention of a multi-flechette canister 126 containing a plurality of first flechettes 16 and a plurality of second flechettes 84. As embodied and illustrated in FIG. 7 a first flechette holding canister 126 includes a plurality of flechettes 16, each having a tip end 54 and a fin end 56 with a plurality of integral fins 70 at the fin end 56 and a plurality of fin forward second, each having a tip portion 86, an end portion 96, and a plurality of integral fins 110 offset from the rod end 98 toward the tip portion 86, wherein the first flechettes 16 and fin forward second flechettes 84 are located adjacent to each other in an alternating fashion with their tips aligned in the same direction.

Preferably the integral fins 110 of the second flechettes 84 are offset from the rod end 98 by a distance that is at least equal to half a length of one of the integral fins 70 of the first flechettes 16.

In an alternative embodiment, the tip end of flechettes 16 and 84 come to a blunt end instead of a point. In this embodiment, the invention may be used in a non-lethal environment.

The foregoing description of the preferred embodiments of the invention has been presented for purposes of illustration and description. It is not intended to be exhaustive or to limit the invention to the precise form disclosed, and modification and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

I claim:

1. A multi-flechette weapon comprising:

a flechette holding canister;

a plurality of first flechettes, each having a tip end and a fin end with a plurality of integral fins at the fin end; and a plurality of second flechettes, each having a tip end and an opposite end and a plurality of integral fins offset from the opposite end toward the tip end, wherein said offset is of a length effective for said integral fins of said plurality of first flechettes to interleave with said integral fins of said plurality of second flechettes whereby a middle portion, disposed between respective adjacent tip ends and fin ends, abut, and wherein the first flechettes and the second flechettes are substantially of equal length and located in the canister and adjacent to each other in an alternating fashion with the tip ends aligned in the same direction.

2. The multi-flechette weapon of claim 1, wherein the plurality of integral fins of the second flechettes are offset a distance at least equal to half a length of one of the integral fins of the first flechettes.

3. The multi-flechette weapon of claim 2 wherein said plurality of first flechettes have a length of from about 1.97 inches to about 2.03 inches and said plurality of second flechettes have a length of from about 1.95 inches to about 2.05 inches.

4. A method of packing a multi-flechette canister comprising the steps of:

providing a multi-flechette canister;

placing in the multi-flechette canister a plurality of first flechettes, each having a tip end and a fin end with a plurality of integral fins at the fin end; and placing in the multi-flechette canister a plurality of second flechettes, each having a tip end and an opposite end and a plurality of integral fins offset from the opposite end toward the tip end, wherein said offset is of a length effective for said integral fins of said plurality of first flechettes to interleave with said integral fins of said plurality of second flechettes whereby a middle portion, disposed between respective adjacent tip ends and fin ends, abut, and wherein the first flechettes and the second flechettes are substantially of equal length and located adjacent to each other in an alternating fashion with the tip ends aligned in the same direction.

5. The method of claim 4, wherein the step of placing the second flechettes includes the step of providing the second flechettes having fins offset at least a distance equal to half of a length of the integral fins of the first flechettes.

6. A multi-flechette canister containing a plurality of abutting flechettes including at least one fin-forward flechette consisting of:

a one-piece steel alloy body having a tip end;

a cylindrical rear portion having an opposite rear end; and a plurality of integral fins offset from the opposite rear end toward the tip end by a distance at least equal to one half the length of one of said integral fins.

* * * * *